US005375925A

United States Patent [19]

Elkin

[11] Patent Number: 5,375,925

[45] Date of Patent: Dec. 27, 1994

[54] MATERIAL BLENDER MIXER AND METHOD THEREFOR

[76] Inventor: Luther V. Elkin, 2431 Rte. 286 West, Indiana, Pa. 15701

[21] Appl. No.: 68,734

[22] Filed: May 28, 1993

[51] Int. Cl.[5] ..... B28C 5/12

[52] U.S. Cl. ..... 366/6; 366/35; 366/38; 366/64; 366/156

[58] Field of Search ..... 366/1, 2, 6, 10, 14, 366/15, 27, 28, 30, 33, 34, 35, 38, 40, 150, 155, 156, 154, 64

[56] References Cited

U.S. PATENT DOCUMENTS

| | | | |
|---|---|---|---|
| 4,298,288 | 11/1981 | Weisbrod | 366/35 |
| 4,556,323 | 12/1985 | Elkin | 366/31 |
| 4,624,575 | 11/1986 | Lantz | 366/35 |
| 4,755,059 | 7/1988 | Elkin | 366/26 |
| 4,768,884 | 9/1988 | Elkin | 366/28 |

OTHER PUBLICATIONS

Ohio Dept. of Transportation, Spec. for "Flowable Controlled Density Fill", Revised Dec. 27, 1990, Sections 636.01–636.13.

*Primary Examiner*—Robert W. Jenkins
*Attorney, Agent, or Firm*—Webb Ziesenheim Bruening Logsdon Orkin & Hanson

[57] ABSTRACT

A material blender mixer is mounted to a chassis of a vehicle. The mixer includes a first material holder bin mounted to the vehicle chassis, a second material holder bin mounted to the chassis positioned reawardly of the first material bin, a device for dispensing the second material from the second material holder bin, a cross auger attached to the chassis and disposed beneath the dispensing device and a mixing auger in fluid communication with the cross auger. A conveyor extends through the first material holder bin and has a dispensing end in fluid communication with the cross auger. A device for agitating the first material in the first material holder bin is provided and includes a vertical agitator and a horizontal agitator, wherein fingers are disposed in both of the agitators adapted to agitate material held in the first material holder bin. Further, a method for preparing a settable material is disclosed, including use of a moist class F fly ash and a dry class C fly ash.

22 Claims, 6 Drawing Sheets

MATERIAL BLENDER MIXER AND METHOD THEREFOR

BACKGROUND OF THE INVENTION

1. Field of the Invention

This invention relates to a material blender mixer and, more particularly, to a material blender mixer for fast-setting materials.

2. Description of the Prior Art

Material blender mixers, such as concrete mixers, are known in the art. Typically, the mixers are mounted to the chassis of vehicles. The mixers make concrete by mixing aggregate, cement and water together in a mixing bin. Typically, the aggregate and the cement are dry components. The mixer then travels to one or more work sites and selectively deposits a predetermined amount of concrete at each site. Generally, the material is continually agitated in the mixing bin to prevent the setting of the mixture.

U.S. Pat. No. 4,768,884, which is hereby incorporated by reference, discloses a material blender mixer that includes a chassis having an aggregate bin, a water tank and a cement dispensing bin attached thereto. Aggregate, water, cement and a fast-setting additive are mixed in a mixing auger thereby forming a fast-setting concrete which can then be deposited at a work site.

The mixer disclosed in U.S. Pat. No. 4,768,884 mixes varying degrees of moist aggregate and dry cement. In some applications a quick-setting, concrete-like material is used and the cement is replaced by dry fly ash and the aggregate is replaced by a moist fly ash. In many instances the moist fly ash cakes and compacts in the aggregate bin. Further, the moist material tends to adhere to the sides of the bin. This results in improper mixing proportions of the dry material and moist material and results in an inferior final product. Further, manual labor may be required to dislodge the caked and compacted moist fly ash from the aggregate bin.

Accordingly, it is an object of my invention to provide a material blender mixer for mixing a fast-setting material at a particular work site wherein one of the constituents of the fast-setting material is a moist material.

SUMMARY OF THE INVENTION

I have invented a material blender mixer mounted to a chassis of a vehicle including a first material holder bin mounted to the chassis, a second material holder bin mounted to the chassis rearward of the first material holder bin, a device for dispensing second material from the second material holder bin, a cross auger attached to the chassis and disposed beneath the dispensing device of the second material holder bin and adapted to receive the second material therefrom, the mixing auger having a receiving end and a discharging end, a bin conveyor extending through the first material holder bin and having a dispensing end in fluid communication with the mixing auger and a device for agitating a first material and the first material holder bin.

The device for agitating a first material in the first material holder bin includes a first device for agitation attached to the chassis. The first device for agitation includes a plurality of shafts each contained within the first material holder bin and having a length extending in a first longitudinal direction and positioned above the bin conveyor. A plurality of V-shaped rods and U-shaped rods defined by radially extending fingers attach to each shaft. The shaft is adapted to oscillate in the first longitudinal direction.

The material blender mixer also includes a device for agitation attached to the chassis that includes at least one agitating conveyor, a portion of which extends in a second longitudinal direction. At least a portion of the agitating conveyor is positioned above the bin conveyor. A finger assembly attaches to the agitating conveyor. The finger assembly includes a plurality of plates attached to the agitating conveyor wherein at least one finger attaches to the plate. The agitating conveyor rotates about a third longitudinal axis.

The material blender mixer also includes a cross auger attached to the chassis, the cross auger having an exit port wherein the cross auger is in fluid communication with the bin conveyor. The receiving end of the mixing auger is positioned below and in fluid communication with the exit port of the cross auger.

A water tank attaches to the chassis and is in fluid communication with the cross auger and the mixing auger. The cross auger includes a bi-directional auger fin. A pipe is provided which is in fluid communication with the water tank and opposite ends of the cross auger.

Preferably, the first material holder bin includes a substantially open-topped container having a base and two spaced apart side walls, a front wall and rear wall attached to the base. The front wall includes an opening adjacent to the base through which the bin conveyor passes. Each of the side walls have an outwardly extending upper portion, a substantially vertical middle portion and a substantially inwardly extending bottom portion.

Further, my invention includes a method of preparing a settable material including the steps of placing a moist class F fly ash in a first bin, placing a dry class C fly ash in a second bin, agitating the moist ash in the first bin, conveying a portion of the agitated moist ash to a mixing auger, depositing a portion of the dry ash into the mixing auger, adding water to the mixing auger and mixing the portion of the moist fly ash, the water and the portion of the dry fly ash together in the mixing auger and forming a settable material.

DESCRIPTION OF THE PREFERRED EMBODIMENT

A material blender mixer 10 mounted to a chassis 12 of a vehicle having wheels 14 made in accordance with the present invention is shown in FIGS. 1–9. The mixer 10 includes a first material holder bin 16 mounted to a forward portion of the chassis 12. The first material holder bin 16 is adapted to contain a moist material such as a class F fly ash. Class F fly ash and class C fly ash are known in the art.

Figure 2:
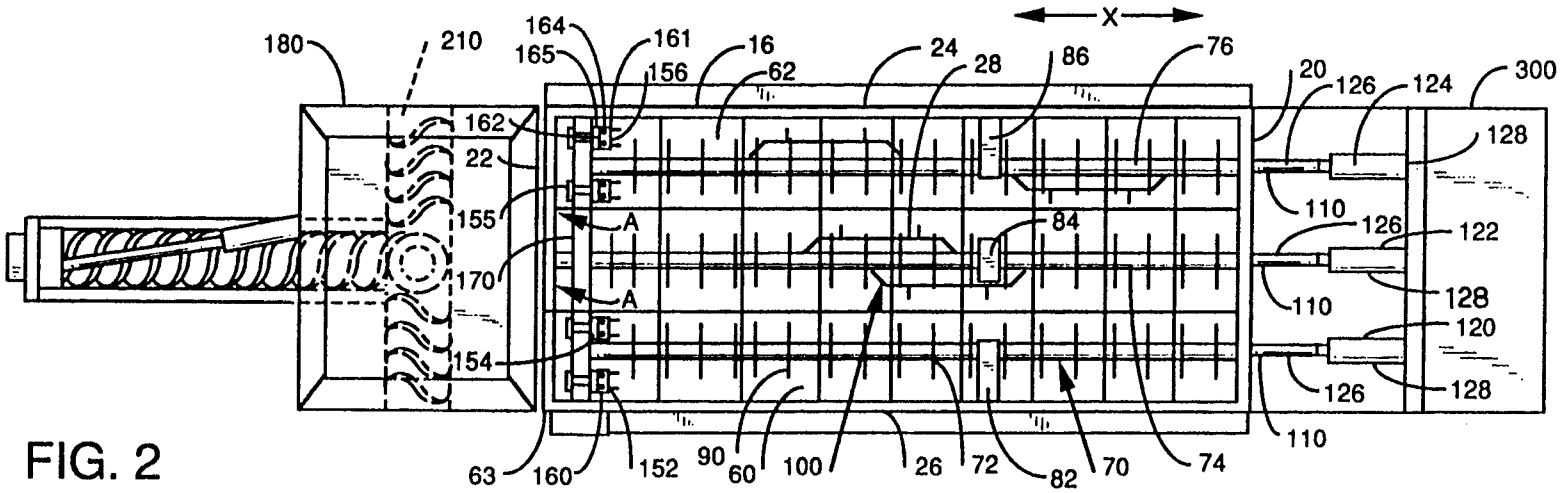
FIG. 2 is a top view of the material blender mixer shown in FIG. 1 showing a longitudinal agitating arrangement and a vertical agitating arrangement contained in a first material holder bin.
Figure 3:
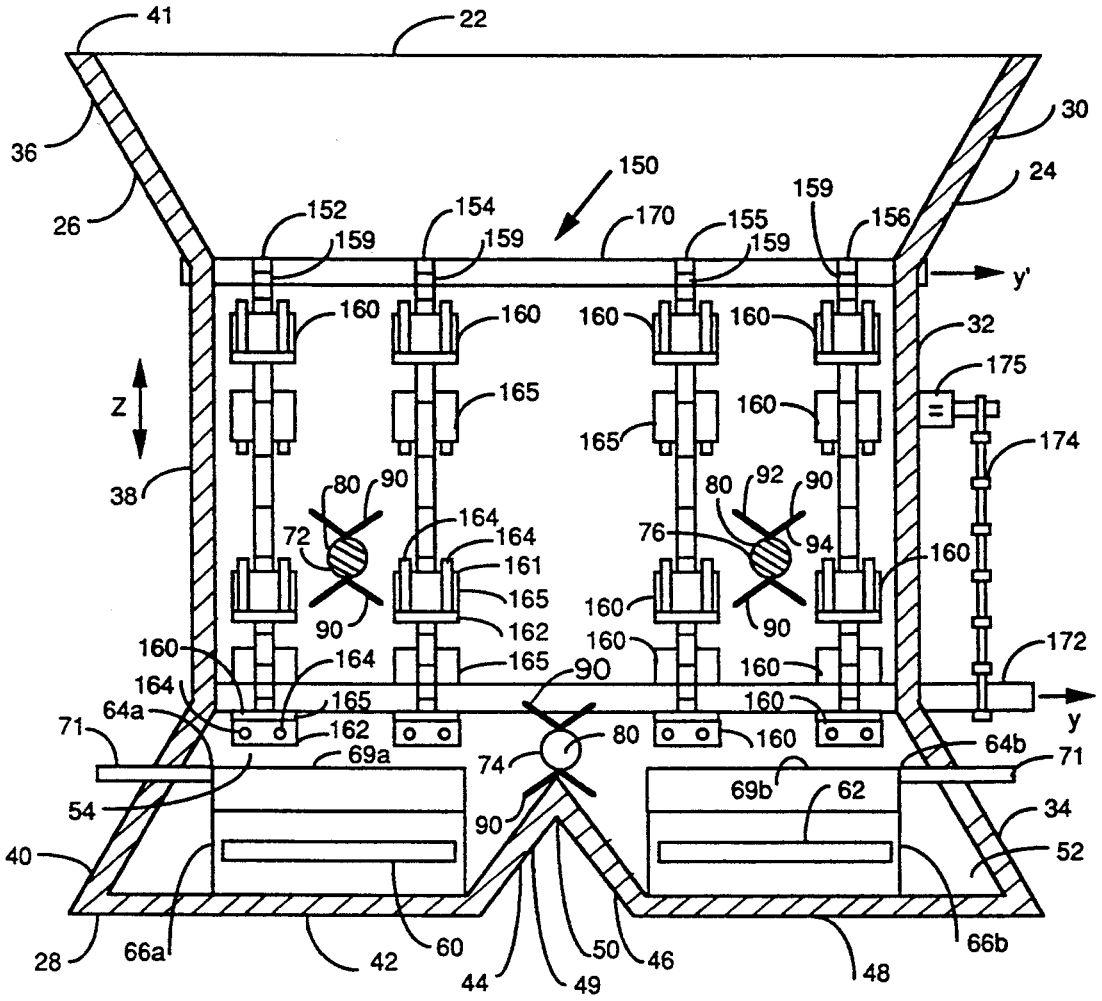
FIG. 3 is a partial sectional view of a first material holder bin of the material blender mixer.

As shown in FIGS. 2 and 3, the first material holder bin 16 includes a front wall 20, a back wall 22, sloping side walls 24 and 26 and a base wall 28. Walls 24 and 26 oppose each other and walls 20, 22, 24, 26 and 28 form an open-topped, box-like structure. Side wall 24 includes side wall segments 30, 32 and 34, wherein segment 30 extends outwardly, segment 32 extends vertically and segment 34 extends inwardly. Likewise, side wall 26 includes side wall segments 36, 38 and 40, wherein segment 36 extends outwardly, segment 38 extends vertically and segment 40 extends inwardly. Accordingly, as one moves from base wall 28 to a top section 41 of bin 10, the distance between inwardly extending segments or bottom portions 34 and 40 decreases; the distance between vertically extending segments or middle portions 32 and 38 remain constant; and the distance between outwardly extending segments or top portions 30 and 36 increases. In other words, walls 24 and 26 define a somewhat hourglass profile, which aids in preventing the moist fly ash or other moist material from adhering to walls 20 and 22.

Base wall 28 includes base segments 42, 44, 46 and 48, wherein segments 42 and 48 extend in a horizontal Y direction as defined by a Y axis and connect side wall segments 40 and 34, respectively. A V-shaped divider portion 49 is defined by base segments 44 and 46 and is provided at a middle section 50 of base wall 28. Segment 44 connects to segment 42 and segment 46 connects to segment 48. Two conveying areas 52 and 54 are defined by base wall 28. Specifically, segments 46 and 48 define area 52 and segments 42 and 44 define area 54.

Figure 4:
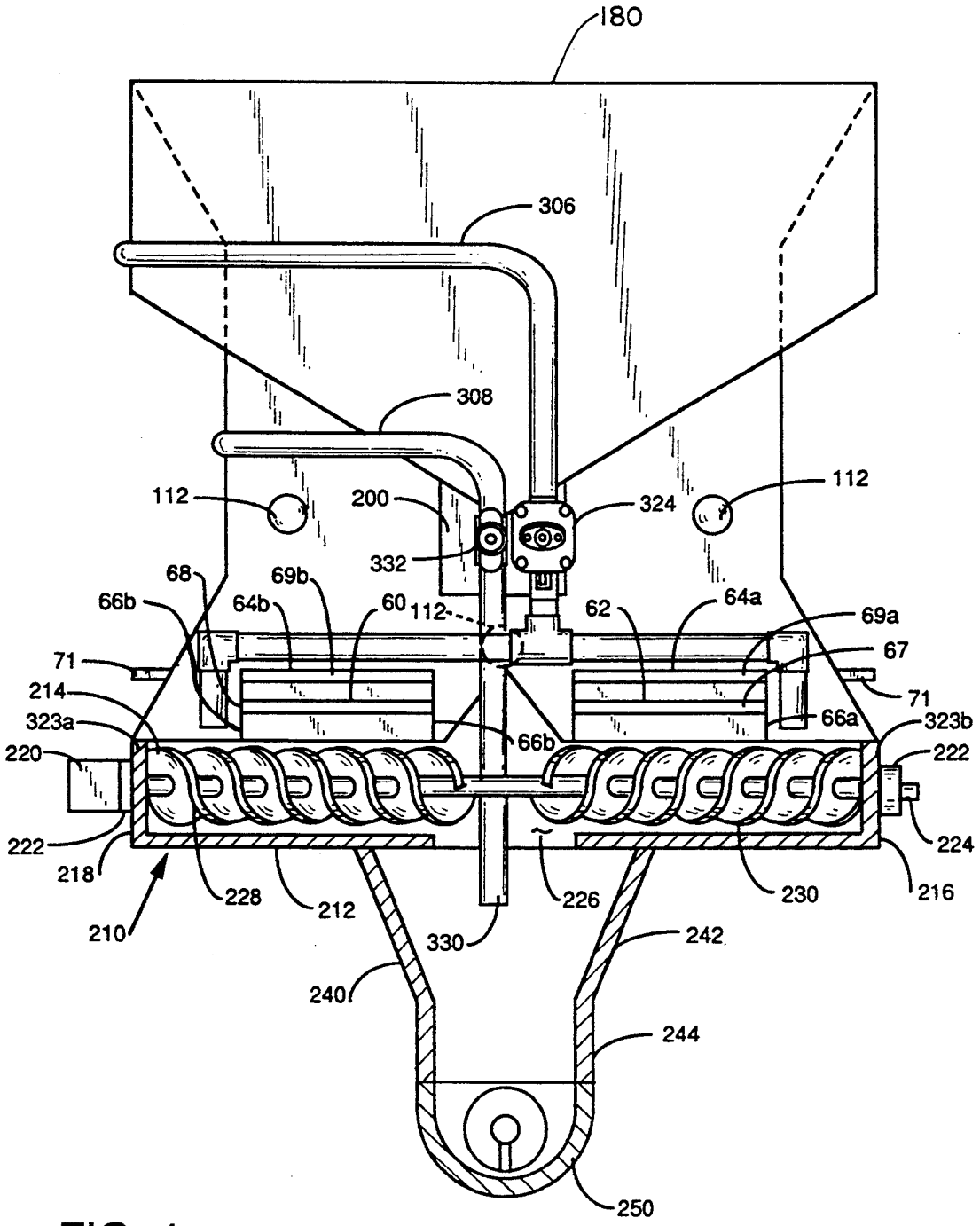
FIG. 4 is a rear view, partially in section, of the material blender mixer showing a mixing auger.

A first conveyor 60 is provided in area 54 and a second conveyor 62 is provided in area 52. Conveyors 60 and 62 are adapted to move moist fly ash material toward a rear end 63 of bin 16 and include conveyor depositing ends 67 and 68, respectively, which pass through metering gates **64*a* and 64*b* and slots 66*a* and 66*b* provided on a lower portion of back wall 22. Conveyors 60 and 62 extend through bin 16. As shown in FIG. 4, conveyor depositing ends or dispensing ends 67 and 68 terminate at a rear end of the chassis 12. Each metering gate 64*a* and 64*b* includes a vertically adjustable plate 69*a* and 69*b*, slidably attached to the back wall 22, to adjust the height of the moist fly ash and, in turn, volume rate of the fly ash, passing through slots 66*a* and 66*b*. Further, each metering gate 64*a* and 64*b* includes a handle 71 attached to the plate and which extends walls 24 and 26 so that the plates 69*a* and 69*b*** can be manually adjusted.

Figure 5:
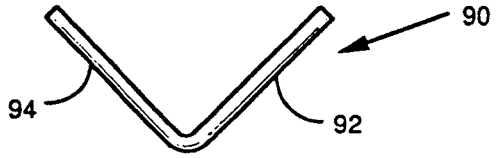
FIG. 5 is a side view of a V-shaped rod of the longitudinal agitating arrangement.
Figure 6:
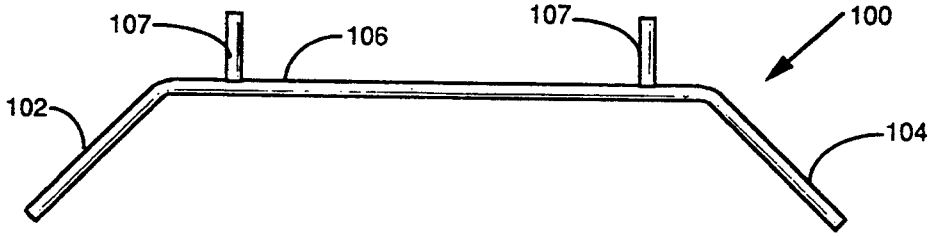
FIG. 6 is a side view of a U-shaped rod of the longitudinal agitating arrangement.
Figure 8:
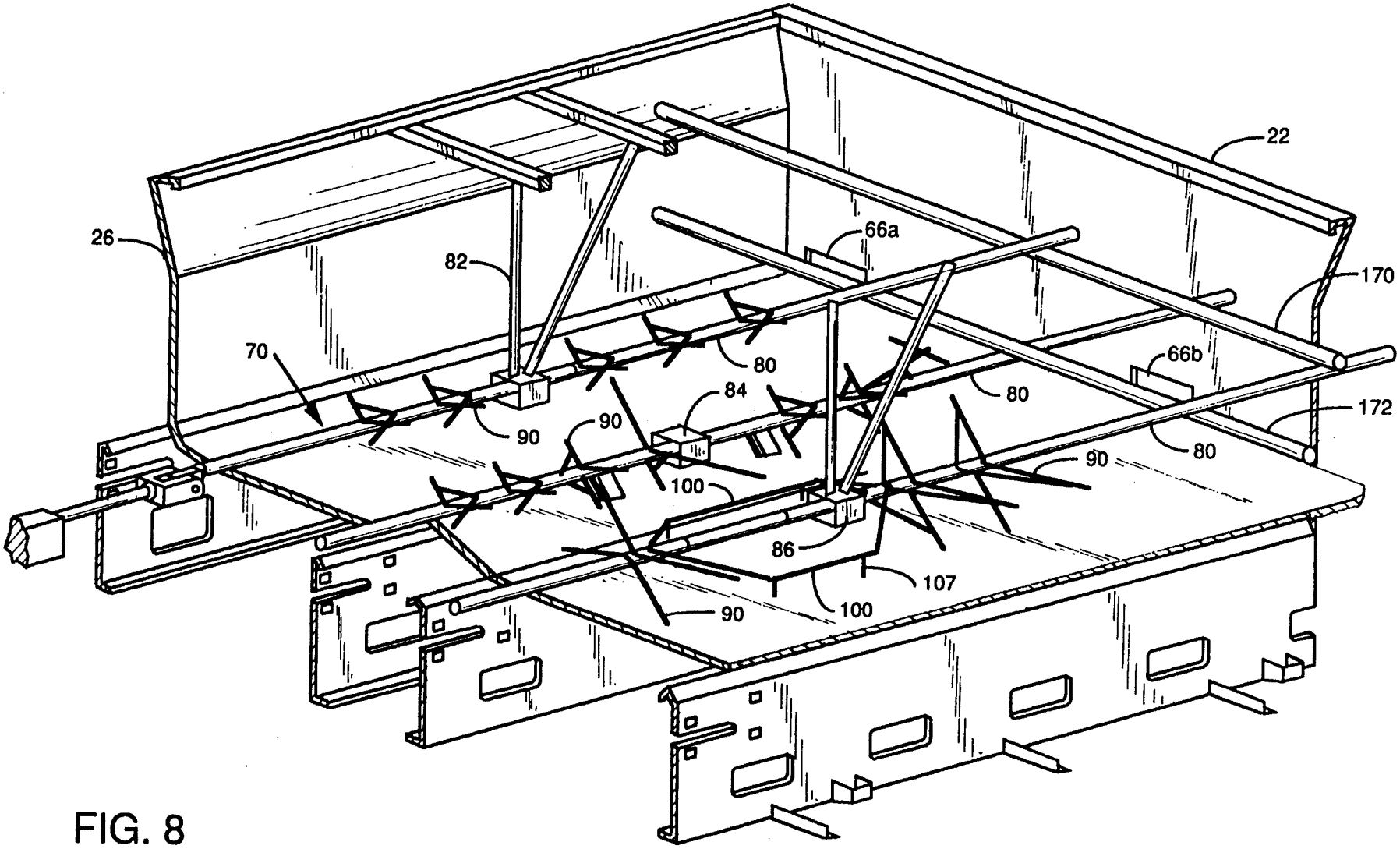
FIG. 8 is a perspective top view showing a portion of the first mixing bin.

As shown in FIGS. 2, 3 and 8, the mixer 10 also includes a longitudinal agitating arrangement 70 that has three longitudinal agitators 72, 74 and 76. Each longitudinal agitator 72, 74 and 76 includes a cylindrical shaft 80 extending along a length of the bin 16 and positioned therein. Shafts 80 of longitudinal agitators 72 and 76 are positioned above conveyors 60 and 62, respectively, and shaft 80 of longitudinal agitator 74 is positioned above divider portion 49. Shafts 80 of longitudinal agitators 72, 74 and 76 are supported by agitator supports 82, 84 and 86. A plurality of radially extending and longitudinally spaced, V-shaped rods 90 are attached to respective shafts 80. As shown in FIG. 5, V-shaped rods 90 are defined by cylindrical diverging integrally attached fingers 92 and 94. A plurality of U-shaped rods 100 are attached to shafts 80 and are defined by diverging cylindrical fingers 102 and 104 attached to a base portion 106. As shown in FIG. 6, a plurality of fingers 107 attach to and depend from base portion 106. The distance between upper ends of fingers 102 and 104 is greater than the distance between upper ends of fingers 92 and 94.

A first end 110 of each shaft 80 passes through front wall 20. A second end 112 of each shaft 80 passes through back wall 22. Bearings (not shown) are provided in walls 20 and 22 and receive respective ends 110 and 112 of shafts 80. Three hydraulic driving arrangements 120, 122 and 124 are provided with each receiving a respective shaft 80. Each hydraulic arrangement 120, 122 and 124 includes a piston 126 received by a cylinder 128. Activation of hydraulic arrangements 120, 122 and 124 causes the pistons 126 to reciprocate in a longitudinal or second horizontal direction X, as defined by an X axis, which in turn causes each shaft 80 and respective rods 90 and 100 to reciprocate in the longitudinal direction X.

Each cylinder 128 attaches to an upwardly extending support structure 140, which attaches to a forward extending section 142 of the chassis 12. The forward extending portion 142 of the chassis 12 then can be attached to a tractor or cab in a manner well-known in the art.

The mixer 10 further includes a vertical agitating arrangement 150 positioned in close proximity to and adjacent to back wall 22, and contained within bin 16. Vertical agitating arrangement 150 includes four agitating conveyors 152, 154, 155 and 156. Conveyors 152, 154, 155 and 156 extend in the vertical Z direction, as defined by a Z axis. Agitating conveyors 152 and 154 are positioned above conveyor 60, and agitating conveyors 155 and 156 are positioned above conveyor 62.

Figure 7:
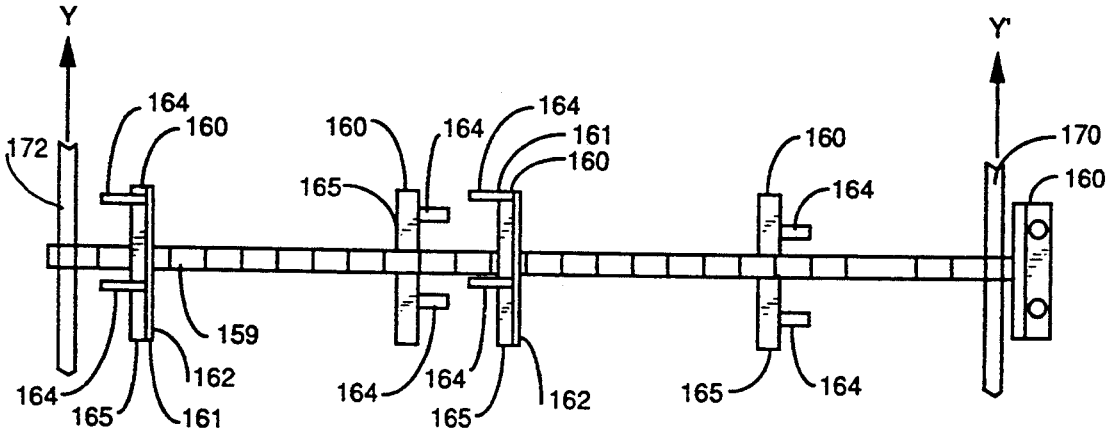
FIG. 7 is a front view of a portion of the vertical agitating arrangement.

As shown in FIG. 7, each conveyor 152, 154, 155 and 156 includes an endless chain or belt 159 and a plurality of spaced finger assemblies 160 attached to the belt 159. Each finger assembly 160 includes an L-shaped support structure 161 having a plate 162 with a set of two agitating fingers 164 depending or extending therefrom and a back plate 165 attached to plate 162. Each conveyor includes five finger assemblies 160. Preferably, fingers 164 on adjacent plates 162 are offset in the horizontal Y direction. The vertical agitating arrangement 150 also includes vertically spaced cylindrical shafts 170 and 172 that pass through walls 24 and 26 and are adapted to drive belts 159. Bearings (not shown) are provided in walls 24 and 26 and receive respective shafts 170 and 172. Shafts 170 and 172 are mechanically coupled to respective belts 159 of conveyors 152, 154, 155 and 156 so that when the shafts 170 and 172 are rotated in the clockwise direction about the Y axis and a Y″ axis, each belt 159 is rotated in the clockwise direction. The mechanical coupling can be accomplished by a friction fit if belts 159 are made of rubber or by a chain and sprocket arrangement both of which are well-known in the art. A portion of shaft 172 depends from wall 24 and is mechanically coupled to an endless belt or chain 174. The mechanical coupling can be similar to that previously described for belt 159. Belt 174 is mechanically coupled in any manner well-known in the art to a motor 175 that is adapted to rotate the belt 174 in the clockwise direction. Motor 175 is attached to wall 24.

A second material holder bin 180 is positioned above depositing ends 67 and 68 and is attached to the chassis 12 through the first material holder bin 16. Bin 180 is adapted to contain a dry material, such as a class C fly ash or cement. Bin 180 is similar to the cement bin disclosed in U.S. Pat. No. 4,768,884. Specifically, bin 180 includes a closed top and downwardly sloping sides adapted to direct dry material to a fly ash dispensing device, such as a metering wheel 200 attached to a lower end of bin 180. Metering wheel 200 can be similar to the metering wheel described in U.S. Patent No. 4,556,323, which is hereby incorporated by reference. Metering wheel 200 is adapted to accurately dispense the dry material into a cross auger 210 which is positioned below and in fluid communication with the metering wheel 200 and depositing ends 67 and 68. The conveyors 60 and 62 and the cross auger 210 may be driven by a variable speed hydraulic motor or the like.

Cross auger 210, which is attached to the chassis 12, includes an auger boot 212 and a bi-directional auger fin or screw 214 attached to end plates 216 and 218. Bearings 222 are received in each of the end plates 216 and 218 and permit an auger fin shaft 224 to pass therethrough. A motor 220 is mounted to end plate 218 and drives shaft 224, and in turn the auger fin 214. A discharge opening or exit port 226 is provided in a central portion of the auger boot 212. The auger boot is flexible and similar to that disclosed in U.S. Pat. No. 4,768,884. It is important to note that the cross auger helical fin has a first section 228 and a second section 230, wherein section 228 is in fluid communication with conveyor 60 and section 230 is in fluid communication with conveyor 62. Each section is adapted to transport material toward opening 226 positioned at the center of cross auger 210 when the shaft 224 is rotated in the clockwise direction. The discharge opening 226 is positioned above and in fluid communication with a hollow bowl 240. The bowl 240 has a frusto-conically shaped top section 242 connected to a cylindrically shaped bottom section 244.

The mixer 10 further includes a mixing auger 250 attached to bowl 240 having a receiving end 252 positioned directly below and in fluid communication with the bowl 240 and a discharging end 254. The mixing auger 250 includes a flexible auger boot which is adjustable and is similar to the mixing auger disclosed in U.S. Patent No. 4,768,884. A hydraulic cylinder 260 has one end attached to the mixing auger 250 near a discharging end 254 and another end attached to the bin 180 or any other rigid location on the mixer 10. When activated, the hydraulic cylinder 260 is either extended or retracted causing the discharging end 254 of the mixing auger 250 to be either raised or lowered.

Optionally, an auger swivel similar to that disclosed in U.S. Pat. No. 4,755,059, which is hereby incorporated by reference, can be attached to the bowl 240. In this case, mixing auger 250 would be pivotally connected to the auger swivel at a point near the receiving end 252 of the mixing auger 250. This would enable the mixing auger 250 to be rotated about its receiving end 252 by the auger swivel so that a discharging end 254 of the mixing auger 250 may be positioned as desired over a work site.

Figure 1:
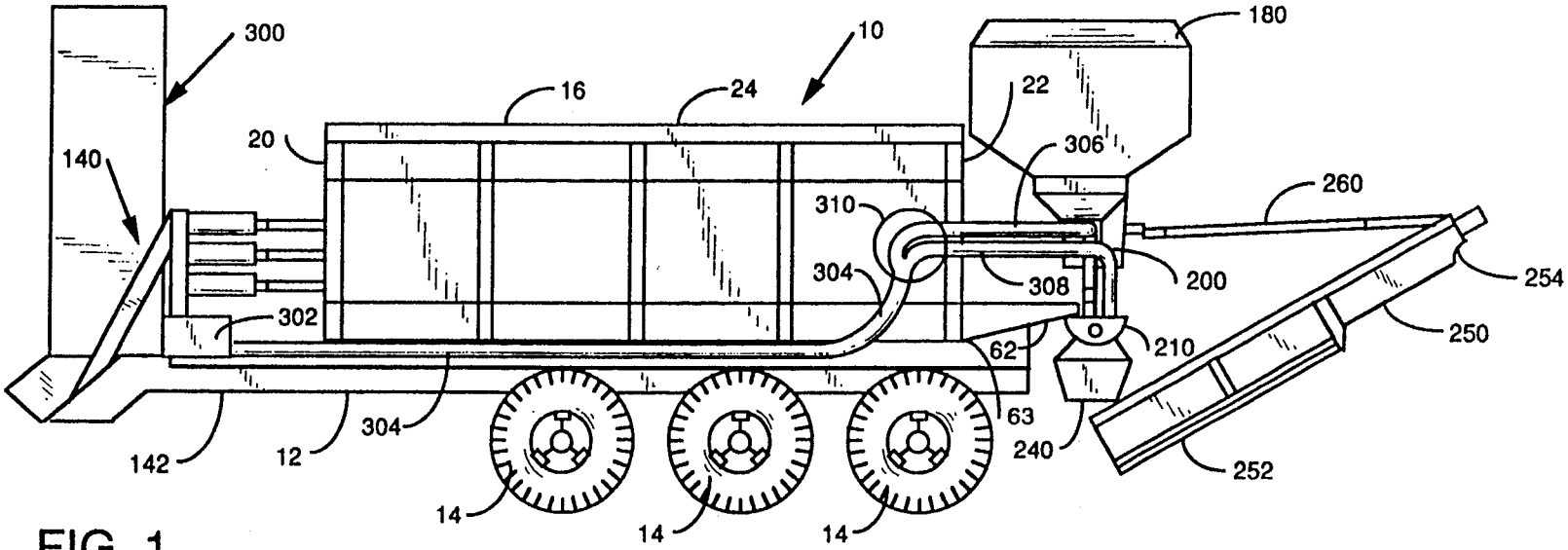
FIG. 1 is a side view of a material blender mixer in accordance with the present invention.
Figure 9:
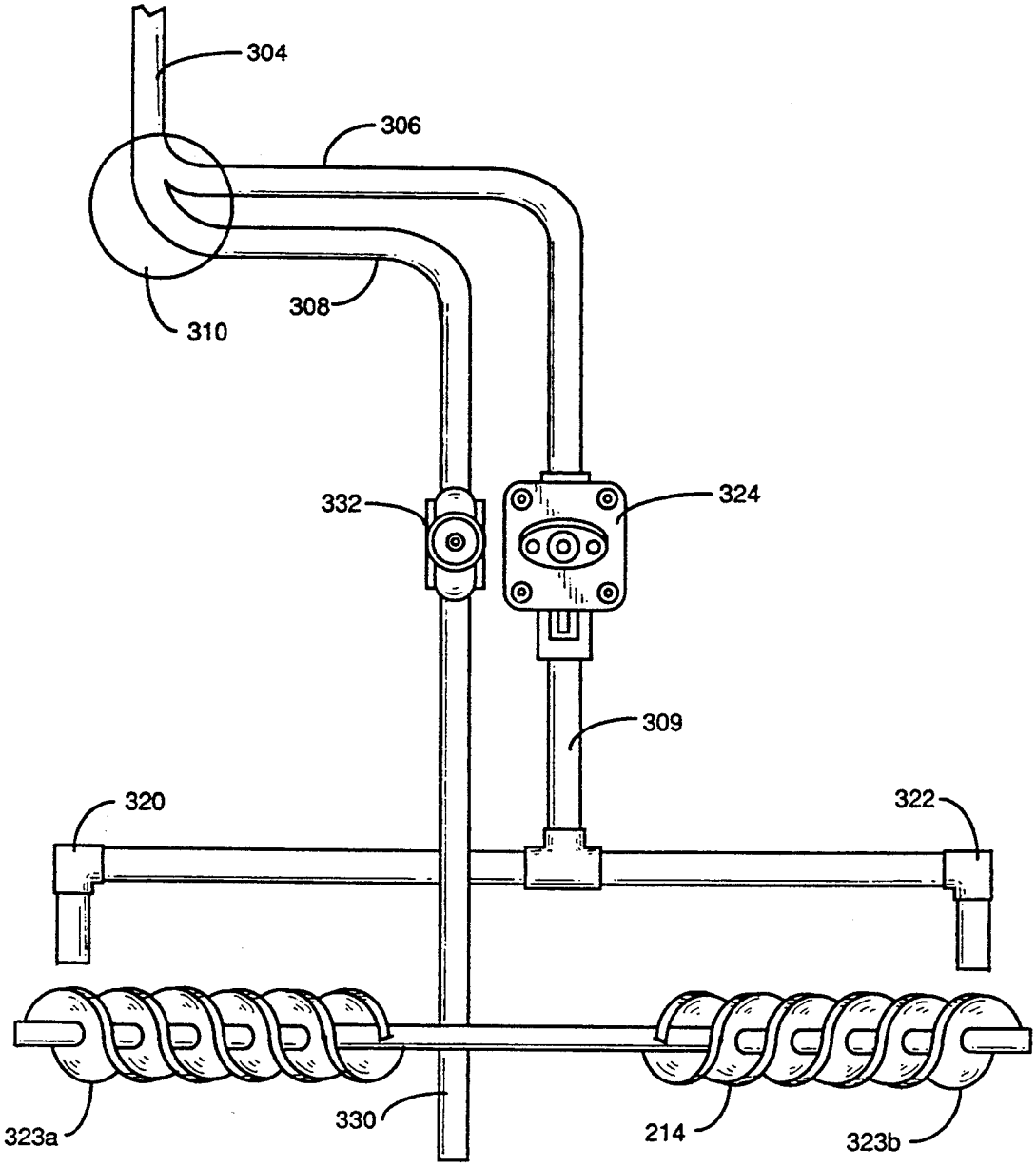
FIG. 9 is a rear view of a portion of the blender mixer showing pipe sections in relationship to the augers.

As shown in FIG. 1, a rectangular shaped water tank 300 is attached to the forward extending section 142 of chassis 12 forwardly of the support structure 140. A pump 302 and a water hose 304 are in fluid communication with the water tank 300. As shown in FIG. 9, the hose 304 extends rearwardly along and is attached to an outer surface of side 26. The hose 304 is diverted into two pipe sections 306 and 308 at a diverter 310. Pipe section 306 has a T-shaped section 309 and has exit nozzles 320 and 322 positioned above and in fluid communication with opposite ends **323*a* and 323*b* of the auger fin 214 adjacent to end plates 216 and 218. An automatic flow adjusting valve 324 is positioned in fluid communication with pipe section 306 to control the flow of water passing through the pipe section 306**.

Pipe section 308 passes through discharge opening 226 and terminates at a discharge end 330 directly above and in fluid communication with the mixing auger 250. An automatic flow adjusting valve 332 is positioned in fluid communication with pipe section 308. Typically, pipes 306 and 308 are made of a polymeric material such as PVC but could be made of other materials such as metal. Flow adjusting valves 324 and 332, which can be hydraulically, electrically or manually operated valves, adjust the volume of water entering the cross auger 210 and mixing auger 250. It has been found that adding water to the cross auger near the auger fin ends **323*a* and 323*b* acts as a lubricant to the auger fin 214 and prolongs the fin life because the class C fly ash is abrasive to the fin 214**.

In operation, the bin 16 is filled with a moist material, such as class F fly ash. Bin 180 is filled with a dry material such as cement or class C fly ash. Bin 300 is filled with water. The longitudinal agitators 72, 74 and 76 are activated, thereby activating hydraulic driving arrangements 120, 122 and 124. This causes each of the shafts 80 to reciprocate in the longitudinal direction X so that fingers 92 and 94 of respective V-shaped rods and fingers 102 and 104 of U-shaped rods to agitate the moist material. Simultaneously, the motor 175 is activated, thereby activating the vertical agitating arrangement 150. Specifically, the belt 174 is rotated in the clockwise direction by the driving motor 175, which in turn causes shaft 172 to rotate in the clockwise direction causing agitating conveyors 152, 154, 155 and 156 to rotate in the clockwise direction. Shaft 170 is rotated in the clockwise direction by belts 159, as shown by arrows A in FIG. 2. Accordingly, the forward most positioned fingers 162 move in the upward, vertical Z direction thereby vertically agitating fly ash near wall 22. The above-described movements of longitudinal agitating arrangement 70 and vertical agitating arrangement 150 prevent settling of the moist fly ash material.

Next, the mixer 10 is positioned so that the rear end of the chassis 12 is near a delivery site. Typically, at this point, the discharging end 254 of the mixing auger 250 is in an elevated position, as shown in FIG. 1. The hydraulic cylinder 260 is activated so that the dispensing end 254 is lowered. Once the mixing auger 250 is in place, the gates **64*a* and 64*b* are adjusted to an appropriate height. The conveyors 60 and 62 are then activated and transport the moist fly ash from the bin 16 through metering gates 64*a* and 64*b* and slots 66*a* and 66*b* to the cross auger sections 228 and 230. The pump 302 and valves 324 and 332 are then activated to supply water to the cross auger 210 and mixing auger 250. The cross auger motor 220 is activated, thereby rotating the auger fin 214. The moist fly ash is then transported from sections 228 and 230 to the central discharge opening 226 where the moist fly ash comes into contact with the dry fly ash from bin 180 exiting from the metering wheel 200. In lieu of a metering wheel 200, any sort of flow control device such as a sliding gate valve could be used to control the flow of the class F fly ash from bin 180 to the mixing auger 250. Typically, the class C fly ash has the consistency of clay. The moist fly ash passes from the cross auger 210 through the bowl 240 and then into the receiving end 252 of the mixing auger 250. The dry fly ash passes through the receiving end 252 of the bowl 240 and into mixing auger 250. Accordingly, the mixing auger 250 is in fluid communication with the dispensing ends 67 and 68 of the conveyors 60 and 62 via the cross auger 210 and the bin 180. A motor of the mixing auger 250** is activated, causing an auger fin to rotate. The mixing auger is of sufficient length to mix the moist fly ash with water and the dry fly ash to form a quick-setting material, which exits as a slurry. It has been found by the Ohio Department of Public Services that the following proportions of class F fly ash, class C fly ash and water result in a satisfactory quick setting material:

1500 lb. class F fly ash
500 lb. class C fly ash
850 lb. water

Typically, the length of the auger should be on the order of ten feet. The mixing auger causes blending of the two fly ash materials and the water as they are carried toward the discharging end 254 of the mixing auger 250 by the auger fin. The mixture is then deposited at the work site into an appropriate deposit area. The operator may control the speeds of the conveyors 60 and 62 and the auger fins of cross auger 210 and mixing auger 250. This then sets forth the volumetric rate in which the mixed material is deposited.

A material blender mixer made in accordance with the above-identified invention solves a problem of mixing a moist material with a dry material at a work site. Specifically, longitudinal agitating arrangement 70 and vertical agitating arrangement 150 overcome a settling problem of the moist material contained in bin 16. Furthermore, the "hourglass" profile of bin 16 assists in dispensing the moist material.

Having described the presently preferred embodiment of my invention, it is to be understood that it may otherwise be embodied within the scope of the appended claims.

I claim:

1. A material blender mixer mounted to a chassis of a vehicle, said mixer comprising: (a) a first material holder bin mounted to the vehicle chassis; (b) a second material holder bin mounted to the chassis rearward of said first material holder bin;

(c) means for dispensing second material from said second material holder bin;

(d) a mixing auger attached to the chassis and disposed beneath said dispensing means of said second material holder bin and adapted to receive the second material therefrom, said mixing auger having a receiving end and a discharging end;

(e) a bin conveyor extending through said first material holder bin and having a dispensing end in fluid communication with said mixing auger; and (f) means for agitating a first material in said first material holder bin, wherein said means for agitating a first material in said first material holder bin comprises a first means for agitation attached to said chassis, said first means for agitation including a shaft having a length extending in a first longitudinal direction positioned above said bin conveyor and contained within said first material holder bin and a finger radially extending from said shaft, said shaft adapted to oscillate in the first longitudinal direction.

2. A material blender mixer claimed in claim 1 wherein said first means for agitation includes a plurality of shafts having a length extending in the first longitudinal direction positioned above said conveyor and contained within said first material holder bin, each of said shafts having a finger radially extending from said respective shaft, each of said shafts adapted to oscillate in the first longitudinal direction.

3. A material blender mixer claimed in claim 2 wherein each of said shafts includes a plurality of said radially extending fingers attached to said shaft and spaced apart along the longitudinal direction.

4. A material blender mixer claimed in claim 1 wherein said shaft includes a plurality of radially extending fingers attached to said shaft and spaced apart along the longitudinal direction.

5. A material blender mixer claimed in claim 1 further comprising a second means for agitation attached to said chassis, said second means including an agitating conveyor, a portion of which extends in a second longitudinal direction, at least a portion of said agitating conveyor positioned above said bin conveyor.

6. A material blender mixer of claim 5 further comprising a finger assembly attached to said agitating conveyor, said finger assembly including an agitating finger.

7. A material blender mixer of claim 6 wherein said finger assembly includes a plate attached to said agitating conveyor and said finger attached to said plate.

8. A material blender mixer of claim 5 further comprising a plurality of finger assemblies attached to said agitating conveyor, each of said finger assemblies including a plate attached to said agitating conveyor and a finger attached to the plate and depending therefrom.

9. A material blender mixer of claim 8 wherein said agitating conveyor rotates about a third longitudinal axis.

10. A material blender mixer of claim 1 further comprising a second radially extending finger integrally attached to said finger, wherein said fingers form a V-shaped structure, said structure attached to said shaft so that said fingers extend radially outward therefrom.

11. A material blender mixer of claim 1 further comprising a second radially extending finger integrally attached to said finger, wherein said fingers form a U-shaped structure, said structure attached to said shaft so that said fingers extend radially outward therefrom.

12. A material blender mixer of claim 1 further comprising a cross auger attached to said chassis, said cross auger having an exit port wherein said cross auger is in fluid communication with said bin conveyor, and said receiving end of said mixing auger positioned below and in fluid communication with said exit port of said cross auger.

13. A material blender mixer as claimed in claim 12 further comprising a water tank attached to the chassis and in fluid communication with said mixing auger.

14. A material blender mixer of claim 1 wherein said first material holder bin comprises a substantially open-topped container having a base and two spaced apart side walls, a front wall and a rear wall attached to said base, said front wall having an opening adjacent said base through which said bin conveyor passes, each of said side walls having an inwardly extending bottom portion, a substantially vertical middle portion and an outwardly extending upper portion.

15. A material blender mixer as claimed in claim 1 further comprising a cross auger attached to said chassis and in fluid communication with said mixing auger and said bin conveyor; and a water tank attached to the chassis and in fluid communication with said cross auger.

16. A material blender mixer as claimed in claim 15 wherein said cross auger includes a bi-directional auger fin having a first end and a second end, said material blender mixer further including a pipe section in fluid communication with said water tank, and said pipe including a first nozzle and a second nozzle positioned in fluid communication with said auger fin first end and said auger fin second end, respectively.

17. A method of preparing a settable material comprising the steps of:

(a) placing a moist class F fly ash in a first bin;
(b) placing a dry class C fly ash in a second bin;
(c) agitating said moist fly ash in said first bin;
(d) conveying a portion of said agitated moist fly ash to a mixing auger;
(e) depositing a portion of said dry fly ash into the mixing auger;
(f) adding water to the mixing auger; and
(g) mixing the portion of said moist fly ash, the water and the portion of said dry fly ash together in the mixing auger, thereby forming a settable material.

18. A material blender mixer mounted to a chassis of a vehicle, said mixer comprising:

(a) a first material holder bin mounted to the vehicle chassis;
(b) a second material holder bin mounted to the chassis rearward of said first material holder bin;
(c) means for dispensing second material from said second material holder bin;
(d) a mixing auger attached to the chassis and disposed beneath said dispensing means of said second material holder bin and adapted to receive the second material therefrom, said mixing auger having a receiving end and a discharging end;
(e) a bin conveyor extending through said first material holder bin and having a dispensing end in fluid communication with said mixing auger; and
(f) means for agitating a first material in said first material holder bin, wherein said means for agitating a first material in said first material holder bin includes means for agitating a first material in a first longitudinal direction positioned above said bin conveyor and in said first material holder bin and means for agitating a first material in a second longitudinal direction positioned above said conveyor and positioned in said bin, wherein said first longitudinal direction is a horizontal direction and said second longitudinal direction is a vertical direction.

19. A material blender mixer mounted to a chassis of a vehicle, said mixer comprising:

(a) a first material holder bin mounted to the vehicle chassis, wherein said first material holder bin comprises a substantially open-topped container having a base and two spaced apart side walls, a front wall and a rear wall attached to said base, said front wall having an opening adjacent said base, each of said side walls having an inwardly extending bottom portion, a substantially vertical middle portion and an outwardly extending upper portion;
(b) a second material holder bin mounted to the chassis rearward of said first material holder bin;
(c) means for dispensing second material from said second material holder bin;
(d) a mixing auger attached to the chassis and disposed beneath said dispensing means of said second material holder bin and adapted to receive the second material therefrom, said mixing auger having a receiving end and a discharging end;
(e) a bin conveyor extending through said first material holder bin and having a dispensing end in fluid communication with said mixing auger, said bin conveyor passes through said opening in said front wall of said first material holder bin; and
(f) means for agitating a first material in said first material holder bin.

20. A material blender mixer mounted to a chassis of a vehicle, said mixer comprising:

(a) a first material holder bin mounted to the vehicle chassis;
(b) a second material holder bin mounted to the chassis rearward of said first material holder bin;
(c) means for dispensing second material from said second material holder bin;
(d) a mixing auger attached to the chassis and disposed beneath said dispensing means of said second material holder bin and adapted to receive the second material therefrom, said mixing auger having a receiving end and a discharging end;
(e) a bin conveyor extending through said first material holder bin and having a dispensing end in fluid communication with said mixing auger; and
(f) means for agitating a first material in said first material holder bin comprising a first means for agitation attached to said chassis having an agitating conveyor, a portion of which extends in a longitudinal direction, at least a portion of said agitating conveyor positioned above said bin conveyor and a finger assembly attached to said agitating conveyor, said finger assembly including an agitating finger.

21. A material blender mixer mounted to a chassis of a vehicle, said mixer comprising:

(a) a first material holder bin mounted to the vehicle chassis;
(b) a second material holder bin mounted to the chassis rearward of said first material holder bin;
(c) means for dispensing second material from said second material holder bin;
(d) a mixing auger attached to the chassis and disposed beneath said dispensing means of said second material holder bin and adapted to receive the second material therefrom, said mixing auger having a receiving end and a discharging end;
(e) a bin conveyor extending through said first material holder bin and having a dispensing end in fluid communication with said mixing auger;
(f) a cross auger attached to said chassis and in fluid communication with said mixing auger and said bin conveyor, and
(g) a water tank attached to the chassis and in fluid communication with said cross auger, wherein said cross auger includes a bi-directional auger fin having a first end and a second end, said material blender mixer further including a pipe section in fluid communication with said water tank, and said pipe including a first nozzle and a second nozzle positioned in fluid communication with said auger fin first end and said auger fin second end, respectively.

22. A material blender as claimed in claim 21 further comprising means for agitating a first material in said first material holder bin.

* * * * *